US008827420B2

(12) United States Patent
Hizawa et al.

(10) Patent No.: US 8,827,420 B2
(45) Date of Patent: Sep. 9, 2014

(54) LIQUID EJECTING APPARATUS

(71) Applicant: Seiko Epson Corporation, Tokyo (JP)

(72) Inventors: Shunichi Hizawa, Matsumoto (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/775,810

(22) Filed: Feb. 25, 2013

(65) Prior Publication Data

US 2013/0222472 A1 Aug. 29, 2013

(30) Foreign Application Priority Data

Feb. 27, 2012 (JP) ..... 2012-040375

(51) Int. Cl.
*B41J 2/165* (2006.01)

(52) U.S. Cl.
CPC ..... *B41J 2/16517* (2013.01); *B41J 2/16511* (2013.01)
USPC ..... 347/31; 347/32

(58) Field of Classification Search
CPC ..... B41J 2/165
USPC ..... 347/30, 31, 32, 33, 34, 37, 38
See application file for complete search history.

(56) References Cited

U.S. PATENT DOCUMENTS

| | | | | |
|---|---|---|---|---|
| 6,460,967 | B1 * | 10/2002 | Makita et al. | 347/33 |
| 6,520,620 | B1 * | 2/2003 | Askren et al. | 347/32 |
| 6,869,163 | B2 * | 3/2005 | Nakashima | 347/31 |
| 6,890,055 | B2 * | 5/2005 | Schalk et al. | 347/32 |
| 2005/0229843 | A1 | 10/2005 | Nishi et al. | |

FOREIGN PATENT DOCUMENTS

| | | |
|---|---|---|
| JP | 2005-305845 | 11/2005 |

* cited by examiner

*Primary Examiner* — Thinh Nguyen
(74) *Attorney, Agent, or Firm* — Workman Nydegger

(57) ABSTRACT

A printer includes a recording head having a nozzle forming surface formed with nozzles adapted to eject liquid; a wiper having an outer surface of a cylindrical surface shape capable of absorbing the ink attached to the nozzle forming surface; a motor that is driven, when moving the wiper in a direction in which the outer surface reaches the nozzle forming surface and in a direction in which the outer surface is separated from the nozzle forming surface, and is also driven when rotating the wiper; and a contact member coming into contact with the outer surface of the wiper rotated along with driving of the motor.

10 Claims, 5 Drawing Sheets

LIQUID EJECTING APPARATUS

BACKGROUND

1. Technical Field

The present invention relates to a liquid ejecting apparatus that has an absorbent member configured to absorb liquid attached onto a nozzle forming surface of an ejecting head.

2. Related Art

As the above-mentioned liquid ejecting apparatus, for example, an ink jet type printer disclosed in JPA-2005-305845 has been known. The absorbent member of the printer moves in a direction along the nozzle forming surface relative to the ejecting head. Moreover, the absorbent member effectively absorbs ink attached to the nozzle forming surface, by sliding on the nozzle forming surface and driven-rotating at the time of the relative movement.

However, when the absorbent member remains in a state of containing the absorbed ink in large quantities, the absorbency of ink declines. For this reason, in order to squeeze the ink from the absorbent member, a configuration is considered which has a contact member capable of coming into contact with the rotating absorbent member. However, when the contact member comes into contact with the absorbent member, the absorbent member is hard to drive and rotate when sliding on the nozzle forming surface. For this reason, the contact member is unable to effectively squeeze the ink from the absorbent member. Thus, from the related art, it has been desired to suppress the decline of absorbency of the ink in the absorbent member.

SUMMARY

An advantage of some aspects of the invention is to provide a liquid ejecting apparatus capable of suppressing the decline of absorbency of a liquid in an absorbent member.

According to an aspect of the invention, there is provided a liquid ejecting apparatus that includes an ejecting head having a nozzle forming surface formed with nozzles adapted to eject liquid; an absorbent member having an outer surface of a cylindrical surface shape capable of absorbing the liquid attached to the nozzle forming surface; a drive source that is driven, when moving the absorbent member in a direction in which the outer surface reaches the nozzle forming surface and in a direction in which the outer surface is separated from the nozzle forming surface, and is also driven when rotating the absorbent member; and a contact member coming into contact with the outer surface of the absorbent member rotated along with driving of the drive source.

According to the liquid ejecting apparatus of the aspect of the invention, when the drive source is driven, the absorbent member moves in the direction reaching the nozzle forming surface and the direction separated from the nozzle forming surface and rotates. That is, the absorbent member can be moved and rotated, along with driving of the same drive source. Moreover, when the contact member comes into contact with the outer surface of the rotating absorbent member, the liquid contained in the absorbent member is effectively squeezed from the absorbent member. For this reason, it is possible to suppress the decline of absorbency of the liquid in the absorbent member.

The liquid ejecting apparatus of the aspect of the invention may have a cam that rotates by driving of the drive source, the cam may move the absorbent member in the direction reaching the nozzle forming surface and in the direction separated from the nozzle forming surface by coming into contact with the absorbent member, and the drive source may rotate the absorbent member in at least one time when the absorbent member is nearest to the nozzle forming surface by the rotation of the cam, and when the absorbent member is farthest from the nozzle forming surface.

According to the liquid ejecting apparatus of the aspect of the invention, when the drive source is driven, the cam rotates, and the absorbent member moves in any one direction of the direction reaching the nozzle forming surface and the direction separated from the nozzle forming surface due to a difference in rotation phase of the cam. That is, by changing the rotation phase of the cam, the movement direction of the absorbent member can be easily changed. Furthermore, when bringing the absorbent member into contact with the contact member and rotating the absorbent member when the absorbent member is nearest to the nozzle forming surface, it is possible to absorb the liquid from the nozzle forming surface by the absorbent member, while squeezing the liquid from the absorbent member. Meanwhile, when bringing the absorbent member into contact with the contact member and rotating the absorbent member when the absorbent member is farthest from the nozzle forming surface, after squeezing the liquid from the absorbent member, by moving the absorbent member in the direction approaching the nozzle forming surface to come into contact with the nozzle forming surface, it is possible to absorb the liquid from the nozzle forming surface.

According to the aspect of the liquid ejecting apparatus of the invention, the absorbent member may have a rotation shaft portion, and the rotation shaft portion may have an absorbent member gear portion which is driven in connection with the drive source at least one time when the absorbent member is nearest to the nozzle forming surface, and when the absorbent member is farthest from the nozzle forming surface, and an engagement portion capable of being engaged with the cam.

According to the liquid ejecting apparatus of the aspect of the invention, the engagement portion of the rotation shaft portion is engaged with the rotating cam, whereby the absorbent member moves in any one direction of the direction approaching the nozzle forming surface and the direction separated from the nozzle forming surface. Moreover, by the movement, in at least one time when being nearest to the nozzle forming surface and when being farthest from the nozzle forming surface, the absorbent member gear portion included in the rotation shaft portion of the absorbent member can be rotated by the driving force of the drive source.

The liquid ejecting apparatus of the aspect of the invention may have a transmission portion including at least one gear that transmits driving of the drive source to the absorbent member gear portion, and the absorbent member gear portion may be located between at least one gear included in the transmission portion and the absorbent member, in a rotation shaft direction of the absorbent member.

In the liquid ejecting apparatus of the aspect of the invention, the absorbent member gear portion may be meshed with at least one gear included in the transmission portion when the absorbent member is nearest to the nozzle forming surface by the rotation of the cam.

In the liquid ejecting apparatus of the aspect of the invention, the absorbent member gear portion may be meshed with at least one gear included in the transmission portion when the absorbent member is farthest from the nozzle forming surface by the rotation of the cam.

In the liquid ejecting apparatus of the aspect of the invention, the absorbent member gear portion may be meshed with at least one gear included in the transmission portion when the absorbent member is nearest to the nozzle forming surface by the rotation of the cam and when the absorbent member is farthest from the nozzle forming surface by the rotation of the cam.

In the liquid ejecting apparatus of the aspect of the invention, the absorbent member may have an absorption portion that absorbs the liquid, the liquid ejecting apparatus may have a wall portion facing both end portion of the absorption portion in the rotation shaft direction of the absorbent member, and the wall portion may be placed between the drive source and the absorption portion in the rotation shaft direction.

According to the liquid ejecting apparatus of the aspect of the invention, since the wall portion is included between the drive source and the absorption portion in the rotation shaft direction, when the liquid absorbed in the absorption portion and the liquid pushed out from the absorption portion are scattered in the rotation shaft direction of the absorbent member, the scattered liquid is covered by the wall portion, and thus it is possible to suppress the attachment of the scattered liquid to the drive source.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, Embodiment 1, which embodies the invention to an ink jet type printer as a kind of a liquid ejecting apparatus, will be described according to FIGS. 1 to 7.

Figure 1:
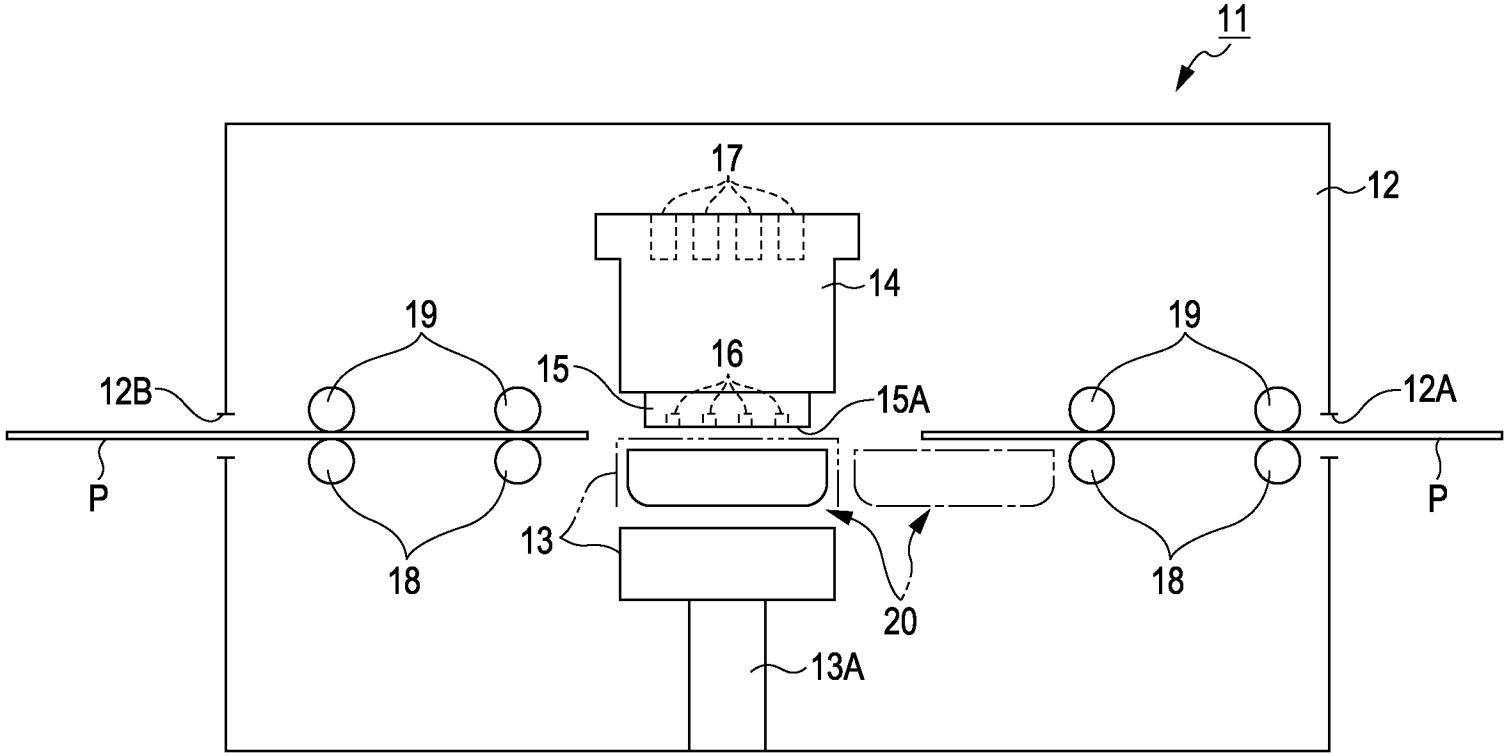
FIG. 1 is a schematic view that shows a schematic structure of a printer of Embodiment 1 related to the invention.

As shown in FIG. 1, a printer 11 has a box-shaped frame 12 serving as an exterior, and a support member 13 forming a rectangular shape when viewed from a plane is provided in a lower portion in the frame 12 from above. A longitudinal direction of the support member 13 corresponds to a horizontal direction in FIG. 1, and the support member 13 is vertically movable between a lower position shown by a solid line in FIG. 1 and an upper position shown by a two-dot chain line by a lifting device 13A.

In the frame 12, at the position vertically facing an upper surface of the support member 13, a head cartridge 14 forming a rectangular box shape corresponding to the support member 13 is fixed, and a recording head 15 as an ejecting head is supported on the lower surface side of the head cartridge 14. On a nozzle forming surface 15A serving as a lower surface facing the upper surface of the support member 13 in the recording head 15, nozzles 16 adapted to eject ink (liquid) are formed so as to form a plurality (as an example, four in FIG. 1) of nozzle rows along the longitudinal direction.

That is, the printer 11 is a so-called line head type printer that has the nozzle forming surface 15A with a length corresponding to the paper width in a width direction of recording paper P to be printed by the ejection of ink from the nozzles 16 using the recording head 15. Moreover, in the head cartridge 14, a plurality of ink cartridges 17 corresponding to each nozzle row of the recording head 15 is mounted in an attachable and detachable manner.

Furthermore, in both side walls facing each other in a transverse direction of the support member 13 in the frame 12, a supply port 12A and a discharge port 12B, through which the recording paper P as an example of a target can pass, are opened and formed at the height positions corresponding to the upper position of the support member 13. Moreover, in the frame 12, a transport roller group including a driving roller 18 and a driven roller 19 are formed between the supply port 12A and the support member 13 and between the support member 13 and the discharge port 12B so as to form a transport path of the recording paper P.

In addition, in the frame 12, between the transport roller group located on the supply port 12A side rather than the support member 13, that is, on the upstream side in the transport direction of the recording paper. P and the transport roller group located on the discharge port 12B side rather than the support member 13, that is, on the downstream side in the transport direction, a head maintenance device 20 adapted to perform the maintenance of the recording head 15 is provided. The head maintenance device 20 is able to move between a maintenance position shown by a solid line in the drawings and a waiting position shown by a dashed line, for example, by a first movement mechanism (not shown) such as a rack and pinion mechanism.

Figure 2:
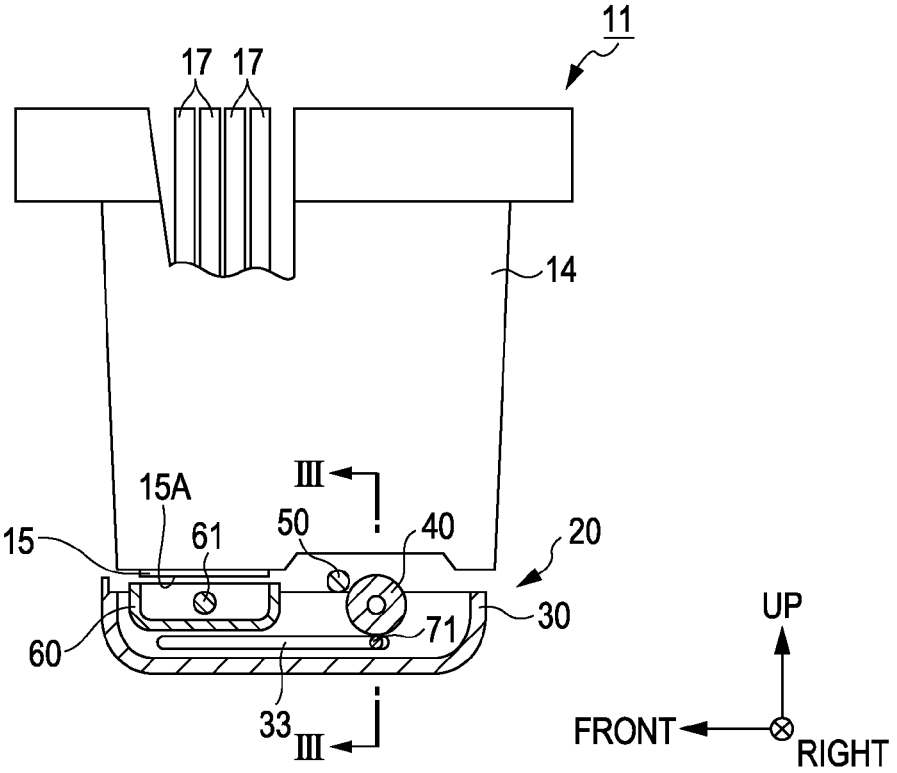
FIG. 2 is a partial cross-sectional side view that shows a side surface structure of a head cartridge and a head maintenance device in the printer of Embodiment 1.
Figure 3:
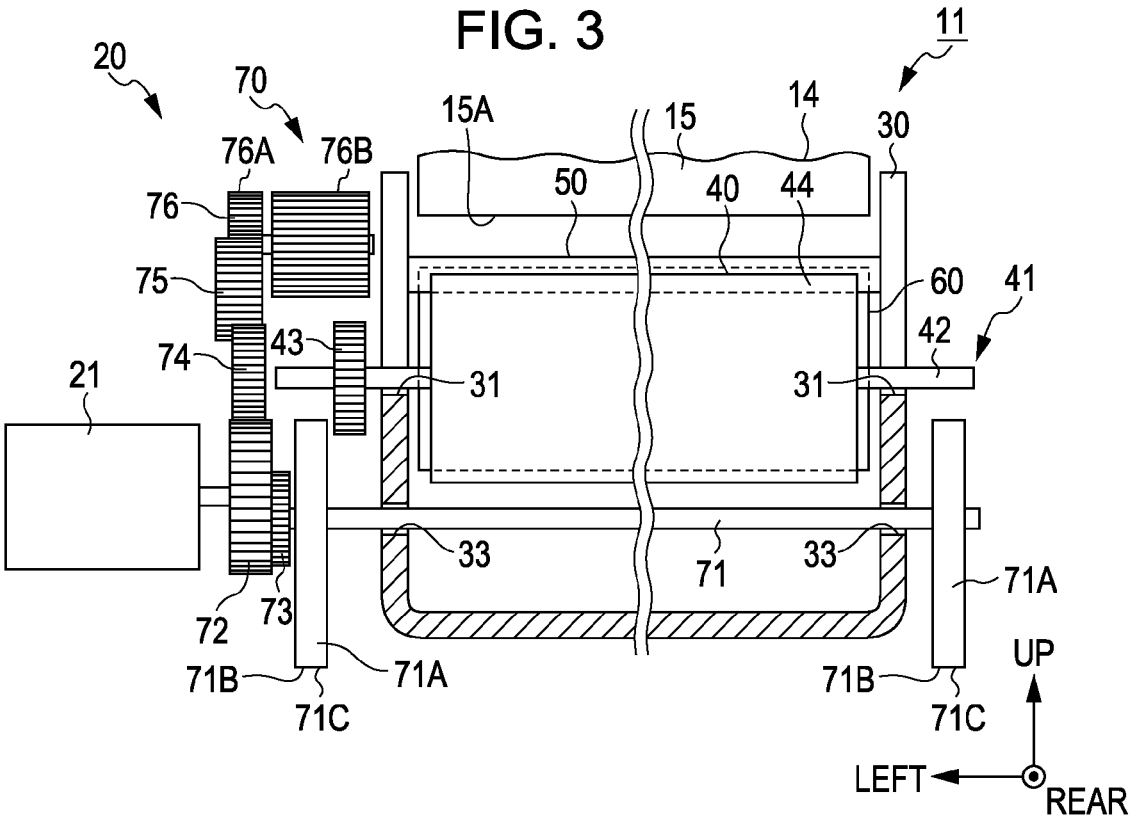
FIG. 3 is a cross-sectional view taken from a line in FIG. 2.

As shown in FIG. 2, the head maintenance device 20 is placed on the lower surface of the head cartridge 14 when being located at the maintenance position. As shown in FIG. 3, the head maintenance device 20 has a guide frame 30 as a wall portion, a wiper 40 as an absorbent member, a contact member 50, and a cap 60.

The head maintenance device 20 moves forward and backward with respect to the head cartridge 14 by the first movement mechanism (not shown). When the head maintenance device 20 is located at the waiting position behind the nozzle forming surface 15A, the printer 11 performs recording on the recording paper. Meanwhile, when the head maintenance device 20 is located at the maintenance position facing the lower surface of the nozzle forming surface 15A, the head maintenance device 20 performs the maintenance operation of the recording head 15. The maintenance operation of the recording head 15 includes a head cleaning operation of removing the ink attached to the nozzle forming surface 15A using the wiper 40, and a protective operation of protecting the nozzle forming surface 15A using the cap 60.

Figure 4:
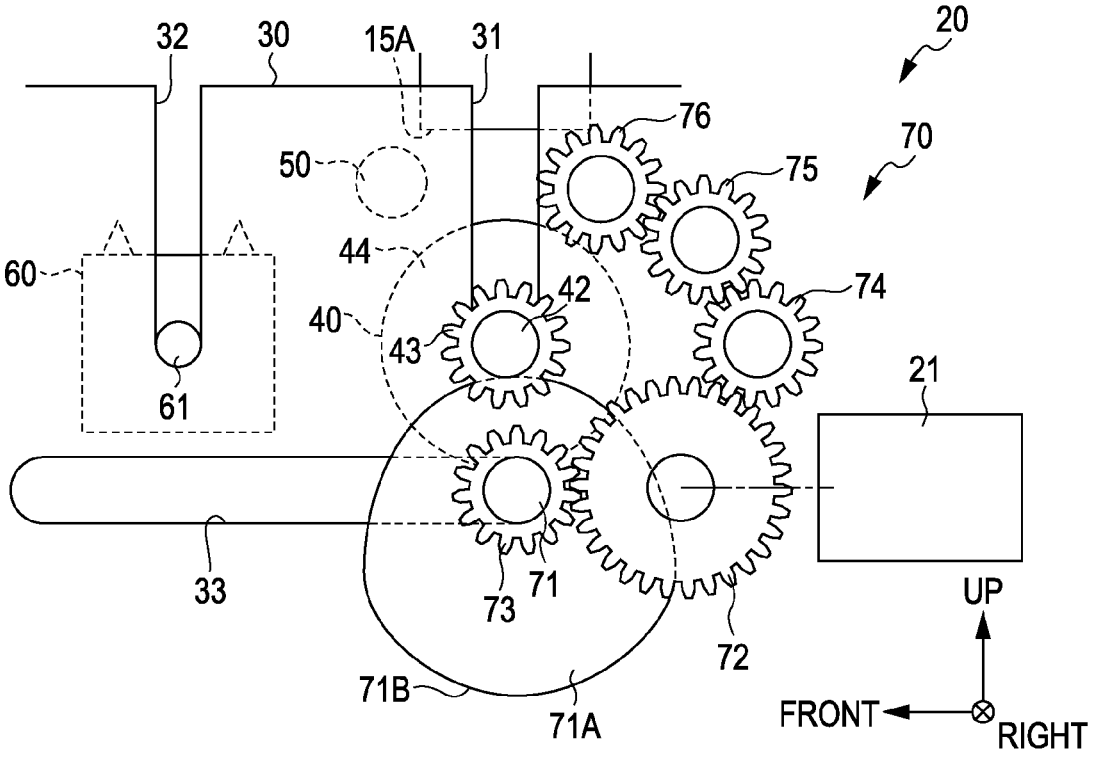
FIG. 4 is a side view that schematically shows major parts of the head maintenance device of Embodiment 1.

The guide frame 30 forms substantially a box shape. As shown in FIG. 4, in the right end portion and the left end portion of the guide frame 30, a wiper guide portion 31, a cap guide portion 32, and a cam shaft guide portion 33 are formed. The wiper guide portion 31 and the cap guide portion 32 are formed as grooves extending vertically. The cam shaft guide portion 33 is formed as a groove extending in a front-back direction.

As shown in FIG. 3, the wiper 40 has a rotation shaft portion 41 and an absorption portion 44. The rotation shaft portion 41 has a wiper shaft 42 as an engagement portion 42, and a wiper gear 43 as an absorbent member gear portion. When the wiper gear 43 rotates, the absorption portion 44 rotates around the wiper shaft 42 integrally with the wiper shaft 42. The right end portion and the left end portion of the wiper shaft 42 are each inserted into the wiper guide portion 31 of the guide frame 30. The wiper gear 43 is connected to the front end portion of the wiper shaft 42. The absorption portion 44 has an outer surface of a cylindrical shape, and is formed of a porous material that absorbs the ink.

The contact member 50 forms a cylindrical rod shape and is fixed to the guide frame 30. As the contact member 50, for example, metallic materials are used. The contact member 50 is placed on the upside and the front side of the wiper 40. The contact member 50 and the wiper 40 are placed parallel to each other.

A motor 21 and a transmission portion 70 as a second movement mechanism and as a drive source are fixedly placed outside the guide frame 30. Parts of the wiper 40, the contact member 50, the cap 60 and the transmission portion 70 are stored inside the guide frame 30. That is, the guide frame 30 is placed between the motor 21 and the absorption portion 44.

The position of the wiper guide 40 with respect to the guide frame 30 and the contact member 50 is changed between the upper position and the lower position by the rotation of the cam 71A. The upper position is the uppermost position of the wiper 40 with respect to the guide frame 30 and the contact member 50. The lower position is the lowermost position of the wiper 40 with respect to the guide frame 30 and the contact member 50.

The wiper 40 is farthest from the contact member 50 when being located at the lower position. The wiper 40 is nearest to the contact member 50 when being located at the upper position. Furthermore, when the wiper 40 is located at the upper position, the absorption portion 44 is pushed to the contact member 50. Furthermore, the absorption portion 44 comes into contact with the nozzle forming surface 15A.

As shown in FIG. 2, the cap 60 has a substantially box shape and is placed on the front side of the wiper 40. The cap 60 is able to cover the whole of the nozzle forming surface 15A when being located at the position corresponding the whole of the nozzle forming surface 15A of the recording head 15. The position of the cap 60 with respect to the nozzle forming surface 15A and the guide frame 30 is changed between the open position and the protective position. The protective position is the uppermost position of the cap 60 with respect to the guide frame 30 and the contact member 50. The open position is the lowermost position of the cap 60 with respect to the guide frame 30 and the contact member 50. The cap 60 protects the nozzle forming surface 15A by covering the nozzle forming surface 15A when being located at the protective position.

As shown in FIG. 3, the transmission portion 70 has a cam shaft 71, a motor gear 72, a cam gear 73, a first transmission gear 74, a second transmission gear 75, and a third transmission gear 76. The cam shaft 71 has cams 71A on the right outside and the left outside of the guide frame 30. The shaft portion of the cam shaft 71 is placed through two cam shaft guide portions 33. When the guide frame 30 moves, the cam shaft guide portion 33 is a recess portion with respect to the fixed camshaft 71. Thereby, the guide frame 30 is able to move without interfering with the cam shaft 71.

The motor gear 72 is connected to an output shaft of the motor 21. The cam gear 73 is connected to the left end portion of the cam shaft 71. The third transmission gear 76 has a front gear portion 76A and a rear gear portion 76B.

The center of the cam gear 73 is placed on the front side of the center of the motor gear 72. The center of the first transmission gear 74 is placed on the upside and the rear side of the center of the motor gear 72. The center of the second transmission gear 75 is placed on the upside and the front side of the center of the first transmission gear 74. The center of the third transmission gear 76 is placed on the upside and the front side of the second transmission gear 75.

The left cam 71A, the motor gear 72, the cam gear 73, the first transmission gear 74, the second transmission gear 75 and the front gear portion 76A are placed on the left side rather than the wiper gear 43 in the horizontal direction. The rear gear portion 76B is placed at the position overlapping with the wiper gear 43 in the horizontal direction.

The maintenance operation will be described.

The guide frame 30 is able to move by a first movement mechanism (not shown) such as a rack and pinion mechanism, and moves in the front-back direction with respect to the motor 21 and the transmission portion 70.

Figure 5:
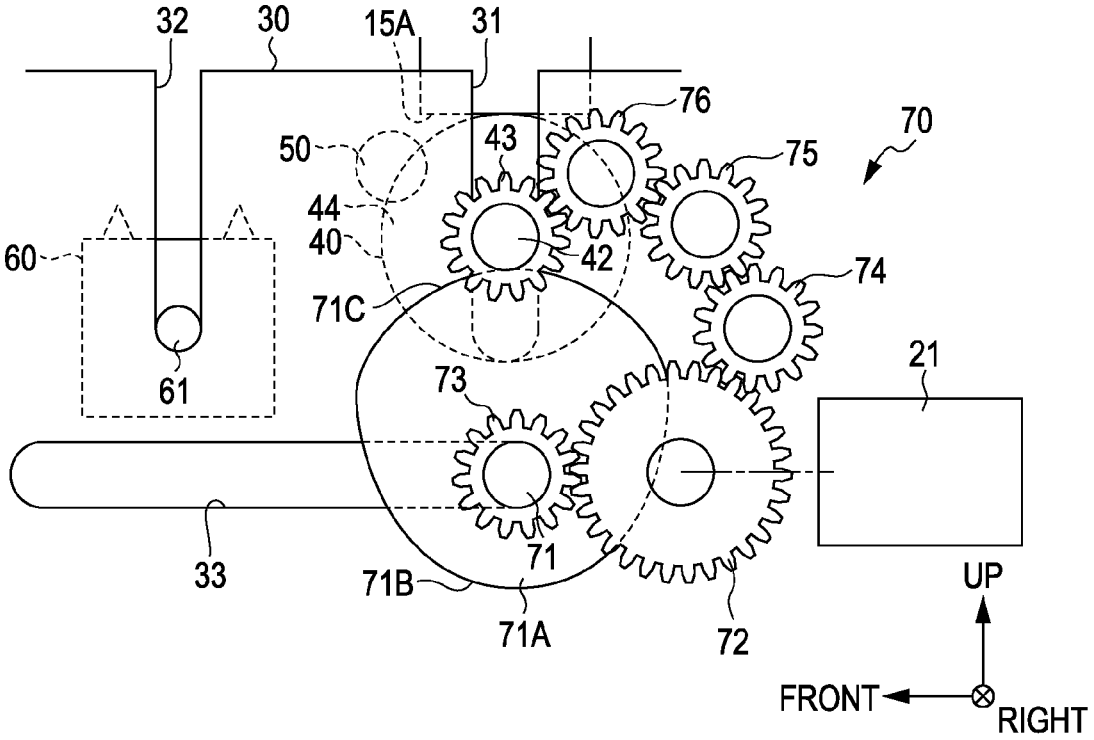
FIG. 5 is a side view that schematically shows major parts of the head maintenance device of Embodiment 1.

As shown in FIGS. 4 and 5, when the guide frame 30 moves to the foremost side with respect to the motor 21 and the transmission portion 70, the motor 21 and the transmission portion 70 are able to move the wiper 40 in the vertical direction. The head maintenance device 20 performs the head cleaning operation when the wiper 40 is located at the position facing the lower surface of the nozzle forming surface 15A and at the position where the motor 21 and the transmission portion 70 are able to move the wiper 40.

Figure 6:
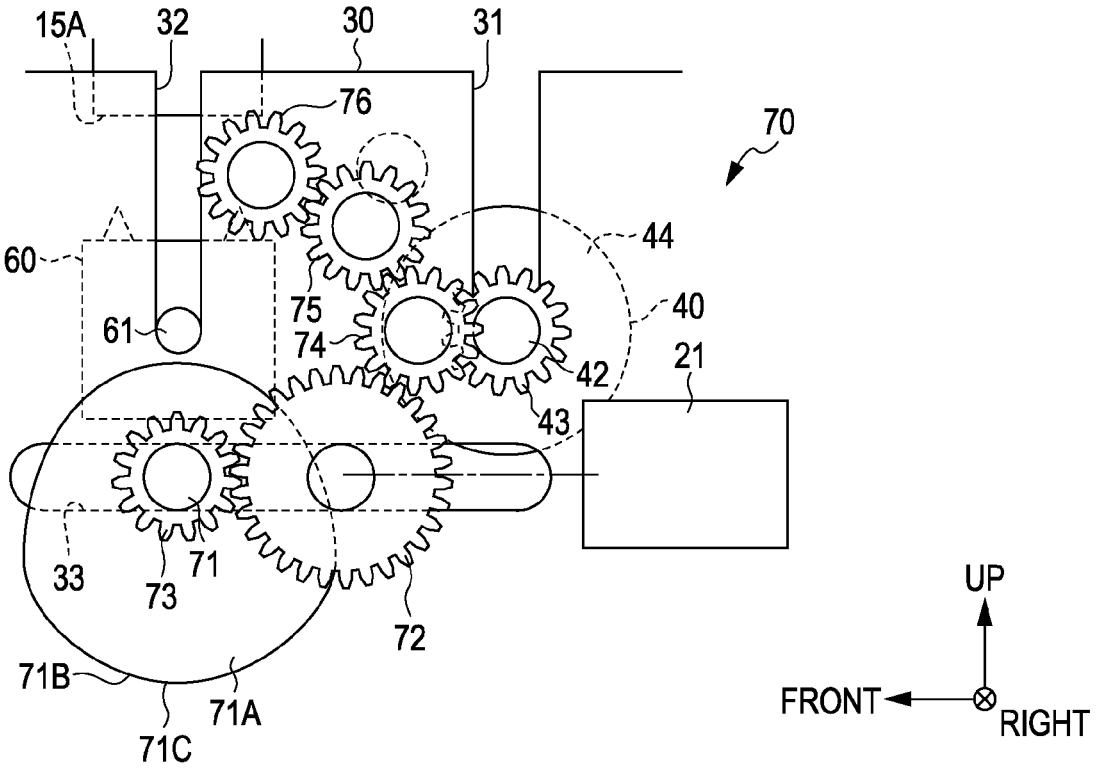
FIG. 6 is a side view that schematically shows major parts of the head maintenance device of Embodiment 1.
Figure 7:
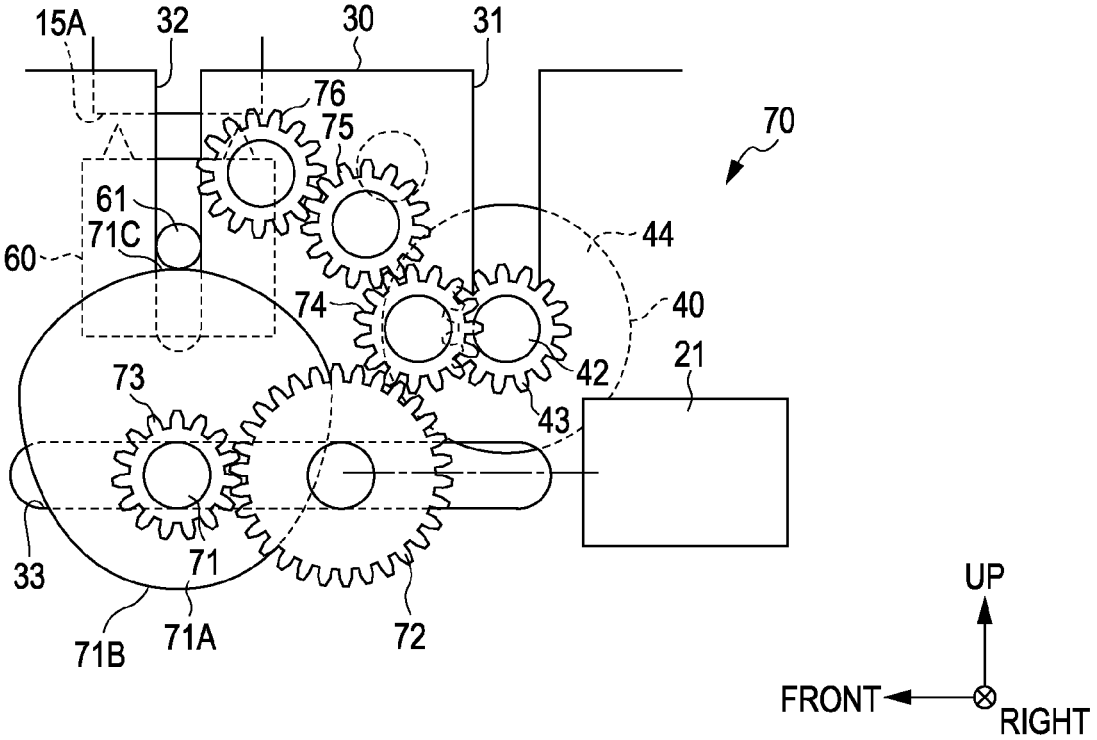
FIG. 7 is a side view that schematically shows major parts of the head maintenance device of Embodiment 1.

As shown in FIGS. 6 and 7, when the guide frame 30 is moved at the hindmost position with respect to the motor 21 and the transmission portion 70, the motor 21 and the transmission portion 70 are able to move the cap 60 in the vertical direction. The head maintenance device 20 performs the protective operation when the cap 60 is moved at the position facing the lower surface of the nozzle forming surface 15A and at the position where the motor 21 and the transmission portion 70 are able to move the cap 60 in the vertical direction.

The head cleaning operation will be described.

As shown in FIG. 4, the motor gear 72 is meshed with the cam gear 73 and the first transmission gear 74. The first transmission gear 74 is meshed with the second transmission gear 75. The second transmission gear 75 is meshed with the front gear portion 76A of the third transmission gear 76. The rear gear portion 76B of the third transmission gear 76 is meshed with the wiper gear 43 when the wiper 40 is located at the upper position. Meanwhile, the rear gear portion 76B is not meshed with the wiper gear 43 when the wiper 40 is located at the lower position.

When the motor 21 is driven, the motor gear 72 rotates. The rotation of the motor gear 72 rotates the cam gear 73 and the first transmission gear 74. The rotation of the first transmission gear 74 rotates the second transmission gear 75 and the third transmission gear 76.

The rotation of the cam gear 73 rotates the cam shaft 71. The cam 71A rotates by the rotation of the cam shaft 71 and the rotation phase of the cam 71A is changed. When the rotation phase of the cam 71A is in a phase in which a pushup portion 71C of the cam surface 71B is located on the downside, the wiper 40 moves downward by gravitational force and moves to the lower position. That is, the wiper 40 moves in the direction separated from the contact member 50. At this time, the absorption portion 44 does not come into contact with the contact member 50.

As shown in FIG. 5, when the rotation phase of the cam 71A is in a phase in which the pushup portion 71C of the cam surface 71B is located on the upside, the cam 71A is engaged with the wiper shaft 42. That is, the pushup portion 71C of the cam 71A comes into contact with the wiper shaft 42. At this time, the wiper 40 is pushed up by the pushup portion 71C and moves to the upper position. That is, the wiper 40 moves in the direction reaching the contact member 50. At this time, the absorption portion 44 comes into contact with the contact member 50. Furthermore, since the wiper gear 43 is meshed with the third transmission gear 76, the wiper 40 rotates by driving force of the motor 21. For this reason, the absorption portion 44 rotates while squeezing the ink absorbed by the contact with the contact member 50 and relatively moves on the nozzle forming surface 15A. The squeezed ink is stored in the bottom of the guide frame 30.

The protective operation will be described.

As shown in FIG. 6, the cam shaft 71 is located on the lower surface of the cap shaft 61 when the transmission portion 70 is located at the position corresponding to the cap 60. The cam shaft 71 is configured so that, when the transmission portion 70 is located at the position corresponding to the cap 60 and when the pushup portion 71C moves downward, the cap 60 moves to the open position by gravitational force.

As shown in FIG. 7, when the transmission portion 70 is located at the position capable of moving the cap 60, the cam shaft 71 rotates by driving force of the motor 21. The pushup portion 71C moves upward, whereby the cap 60 is pushed up by the pushup portion 71C and moves to the protective position. The cap 60 is located at the protective position, thereby to suppress the evaporation of moisture of ink in the nozzles due to the contact of the cap 60 with the nozzle forming surface.

According to the above-mentioned embodiment, the following effects can be obtained.

(1) The printer 11 has the recording head 15 having the nozzle forming surface 15A formed with the nozzles 16 adapted to eject the ink, the wiper 40 having the outer surface of the cylindrical shape capable of absorbing the ink attached to the nozzle forming surface 15A, the motor 21, and the contact member 50. The motor 21 is driven when moving the wiper 40 in the direction in which the outer surface reaches the nozzle forming surface 15A and in the direction in which the outer surface is separated from the nozzle forming surface 15A, and is also driven when rotating the wiper 40. The contact member 50 comes into contact with the outer surface of the wiper 40 rotated along with driving of the motor 21.

When the motor 21 is driven, the wiper 40 moves in the direction reaching the nozzle forming surface 15A and in the direction separated from the nozzle forming surface 15A and rotates. That is, it is possible to move and rotate the wiper 40 along with driving of the same motor 21. Moreover, when the contact member 50 comes into contact with the outer surface of the rotating wiper 40, the ink contained in the wiper 40 is effectively squeezed from the wiper 40. For this reason, it is possible to suppress the decline of absorbency of the ink in the wiper 40.

Furthermore, since it is possible to move and rotate the wiper 40 along with driving of the same motor 21, the number of the motor can be reduced compared to a case of performing the movement and the rotation of the wiper 40 by the separate motors.

(2) The printer 11 has the cam 71A rotating by driving of the motor 21, and the cam 71A is engaged with the wiper 40 to move the wipe 40 in the direction reaching the nozzle forming surface 15A and in the direction separated from the nozzle forming surface 15A.

When the motor 21 is driven, the cam 71A rotates, and the wiper 40 moves in any one direction of the direction reaching the nozzle forming surface 15A and the direction separated from the nozzle forming surface 15A, due to the difference of the rotation phase of the cam 71A. That is, by changing the rotation phase of the cam 71A, the movement direction of the wiper 40 can be easily changed.

(3) The motor 21 rotates the wiper 40 when the wiper 40 is nearest to the nozzle forming surface 15A by the rotation of the cam 71A. For this reason, it is possible to absorb the ink from the nozzle forming surface 15A by the wiper 40, while squeezing the ink from the wiper 40.

(4) The wiper 40 has the rotation shaft portion 41, and the rotation shaft portion 41 has the wiper gear 43 that is driving-connected to the motor 21 when the wiper 40 is nearest to the nozzle forming surface 15A, and the wiper shaft 42 capable of being engaged with the cam 71A.

The wiper 40 moves in the direction reaching the nozzle forming surface 15A by pushing the wiper shaft 42 up to the pushup portion 71C of the rotating cam 71A. Moreover, by the movement, when being nearest to the nozzle forming surface 15A, it is possible to rotate the wiper gear 43 provided in the rotation shaft portion 41 of the wiper 40 by driving force of the motor 21.

(5) The printer 11 has the guide frame 30 facing both end portions of the absorption portion 44 in the rotation shaft direction of the wiper 40. The guide frame 30 is placed between the motor 21 and the absorption portion 44 in the rotation shaft direction of the wiper 40. For this reason, when the ink absorbed in the absorption portion 44 and the ink pushed out from the absorption portion 44 are scattered in the rotation shaft direction of the wiper 40, the scattered ink is blocked by the guide frame 30, and thus the attachment of the ink to the motor 21 can be suppressed.

Embodiment 2

The printer 11 of the embodiment differs from the head maintenance device 20 of Embodiment 1 in the following points. That is, the printer 11 of the embodiment has a transmission portion 170 instead of the transmission portion 70. Furthermore, the arrangement of the contact member 50 is changed. In addition, the details different from the printer 11 of Embodiment 1 will be described below, and the configurations common to Embodiment 1 are denoted by the same reference numerals, and a part or all of the descriptions thereof will be omitted.

Figure 8:
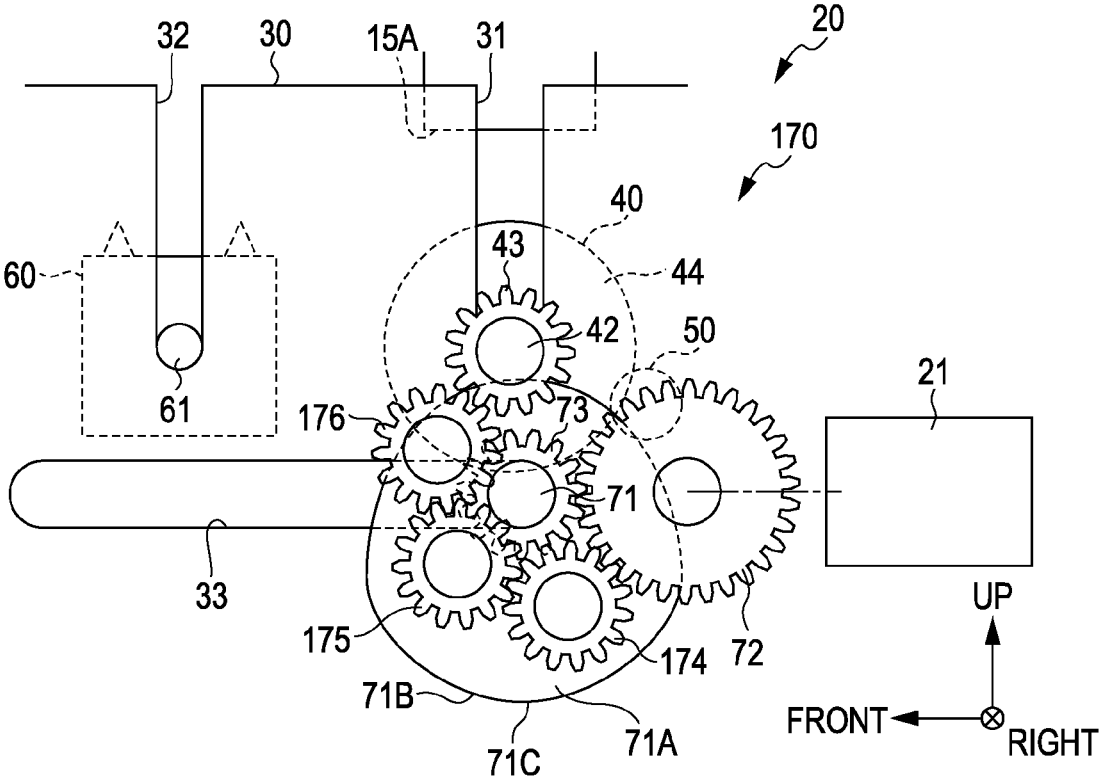
FIG. 8 is a side view that schematically shows major parts of the head maintenance device of Embodiment 2 of the invention.

As shown in FIG. 8, the contact member 50 is placed on the lower side and the rear side of the wiper 40. When being located at the upper position, the wiper 40 is farthest from the contact member 50 and comes into contact with the nozzle forming surface 15A. When being located at the lower position, the wiper 40 is nearest to the contact member 50 and does not come into contact with the nozzle forming surface 15A.

The transmission portion 170 has a cam shaft 71, a motor gear 72, a cam gear 73, a first transmission gear 174, a second transmission gear 175 and a third transmission gear 176.

The center of the first transmission gear 174 is placed on the downside and the front side of the center of the motor gear 72. The center of the second transmission gear 175 is placed on the upside and the front side of the center of the first transmission gear 174. The center of the third transmission gear 176 is placed on the upside and the front side of the center of the second transmission gear 175.

The motor gear 72 is meshed with the cam gear 73 and the first transmission gear 174. The first transmission gear 174 is meshed with the second transmission gear 175. The second transmission gear 175 is meshed with the third transmission gear 176. The third transmission gear 176 is meshed with the wiper gear 43 when the wiper 40 is located at the lower position. Meanwhile, the third transmission gear 176 is not meshed with the wiper gear 43 when the wiper 40 is located at the upper position.

When the motor 21 is driven, the motor gear 72 rotates. The rotation of the motor gear 72 rotates the cam gear 73 and the first transmission gear 174. The rotation of the first transmission gear 174 rotates the second transmission gear 175 and the third transmission gear 176.

When the pushup portion 71C is located at the upper position, the pushup portion 71C of the cam 71A is engaged with the wiper shaft 42. At this time, the wiper 40 is pushed up by the pushup portion 71C and moves to the upper position. That is, the wiper 40 moves in the direction separated from the contact member 50. At this time, the absorption portion 44 does not come into contact with the contact member 50. Furthermore, the absorption portion 44 is driven and rotates by frictional force due to the relative movement with the nozzle forming surface 15A.

Figure 9:
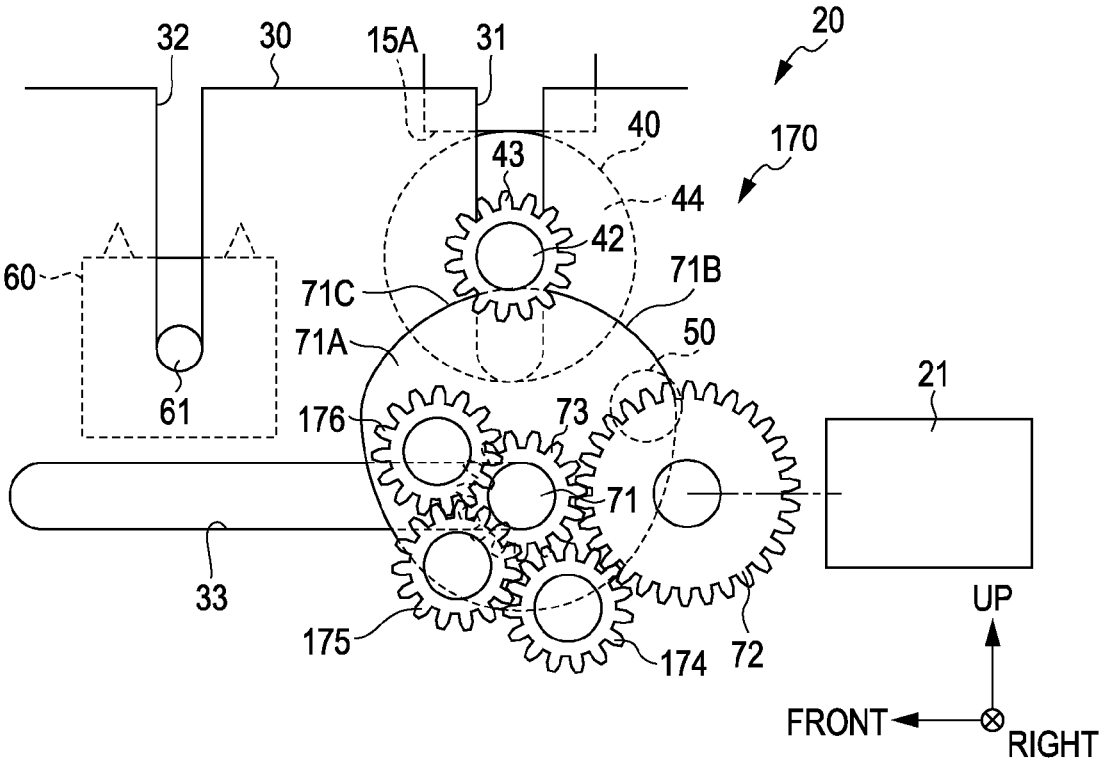
FIG. 9 is a side view that schematically shows major parts of the head maintenance device of Embodiment 2.

As shown in FIG. 9, the rotation of the cam gear 73 rotates the cam shaft 71. The cam 71A rotates by the rotation of the cam shaft 71. When the pushup portion 71C of the cam surface 71B is located at the lower position, the wiper 40 moves downward and moves to the lower position due to gravitational force. That is, the wiper 40 moves in the direction separated from the contact member 50. At this time, the wiper 44 comes into contact with the contact member 50. Furthermore, since the third transmission gear 176 is meshed with the wiper gear 43, the wiper 40 rotates by driving force of the motor 21. For this reason, the absorption portion 44 rotates while squeezing the ink absorbed by the contact with the contact member 50. The squeezed ink is stored in the bottom of the guide frame 30.

According to the above-mentioned embodiment, the following effects can be obtained, in addition to the effects of (1), (2) and (5) of Embodiment 1.

(6) The motor 21 rotates the wiper 40 when the wiper 40 is farthest from the nozzle forming surface 15A. For this reason, by bringing the contact member 50 into contact with wiper 40 to rotate the wiper 40 when the wiper 40 is farthest from the nozzle forming surface 15A, after the ink is squeezed from the wiper 40, the ink can be absorbed from the nozzle forming surface 15A by moving the wiper 40 in the direction reaching the nozzle forming surface 15A to bring the wiper 40 into contact with the nozzle forming surface 15A.

(7) The wiper 40 has the rotation shaft portion 41. The rotation shaft portion 41 has the wiper gear 43 driving-connected to the motor 21 when the wiper 40 is farthest from the nozzle forming surface 15A, and the wiper shaft 42 capable of rotating integrally with the wiper 43 and being engaged with the cam 71A. The wiper 40 moves in the direction separated from the nozzle forming surface 15A due to gravitational force by the separation of the pushup portion 71C of the rotating cam 71A from the wiper shaft 42. Moreover, when the wiper 40 is farthest from the nozzle forming surface 15A by the movement, the wipe 40 can be rotated by driving force of the motor 21.

In addition, the above-mentioned embodiments may be changed to other embodiments as follows.

The contact member 50 of Embodiment 1 is placed on the front side and the upside of the wiper 40. Meanwhile, the contact member 50 of the modification example is placed on the rear side and the upside of the wiper 40.

The contact member 50 of Embodiment 2 is placed on the rear side and the downside of the wiper 40. Meanwhile, the contact member 50 of the modification example is placed on the front side and downside of the wiper 40.

In Embodiment 1, the transmission portion 70 is meshed with the wiper gear 43 when the wiper 40 is nearest to the nozzle forming surface 15A by the rotation of the cam 71A. Furthermore, in Embodiment 2, the transmission portion 170 is meshed with the wiper gear 43 when the wiper 40 is farthest from the nozzle forming surface 15A by the rotation of the cam 71A. Meanwhile, the transmission portion of the modification example is meshed with the wiper gear 43 when the wiper 40 is nearest to the nozzle forming surface 15A by the rotation of the cam 71A and when the wiper 40 is farthest from the nozzle forming surface 15A by the rotation of the cam 71A. Specifically, both of the transmission portion 70 and the transmission portion 170 are included. In this case, one of the transmission portion 70 and the transmission portion 170 may be placed on the right side of the guide frame 30, and the other of the transmission portion 70 and the transmission portion 170 may be placed on the left side of the guide frame 30.

The transmission portion 70 and the transmission portion 170 of each embodiment have the motor gear 72, the cam gear 73, the first transmission gear 74, the second transmission gear 75 and the third transmission gear 76. Meanwhile, the transmission portion 70 and the transmission portion 170 of the modification example have a pulley and a belt instead of theses gears.

Although the transmission portion 70 and the transmission portion 170 of each embodiment have the motor gear 72, the cam gear 73, the first transmission gear 74, the second transmission gear 75 and the third transmission gear 76, if a transmission portion is able to transmit driving force of the motor 21 to the cam shaft 71 and the wiper 40, the number and the arrangement of the gear can be freely changed.

The motor 21 of each embodiment is placed outside the guide frame 30. Meanwhile, the motor 21 of the modification example is placed inside the guide frame 30.

The contact member 50 of each embodiment is fixed to the guide frame 30. Meanwhile, the contact member 50 of the modification example is supported by the guide frame 30 so as to be rotatable around the shaft of the contact member 50.

Although the contact member 50 of each embodiment having a cylindrical rod shape has been adopted, it is also possible to adopt a scraper shape or a rod shape having a rectangular cross-section.

Although the wiper 40 of each embodiment has the rotation shaft portion 41 as an engagement portion rotatable integrally with the wiper gear 43, it is also possible to adopt an engagement portion attached to the rotation shaft portion 41. In this case, the engagement portion can have a configuration that does not rotate integrally with the wiper gear 43.

In each embodiment, although the liquid ejecting apparatus has been embodied as the line-type printer 11, the invention can also be applied to a serial type printer.

In each embodiment, although the liquid ejecting apparatus has been embodied as the ink jet type printer 11, the liquid ejecting apparatus may be embodied as a fluid ejecting device that ejects or discharges other fluids other than ink. It is possible to utilize various liquid ejecting apparatuses that include a liquid ejecting head or the like configured to discharge a minute amount of liquid droplets. In addition, the liquid droplet refers to a liquid state that is discharged from the liquid ejecting apparatus, and also includes one leaving traces in a granular shape, a tear shape, and a filiform shape. Furthermore, liquid described herein may be a material capable of being ejected from the liquid ejecting apparatus. For example, the material may include a state when a substance is a liquid phase, and includes a liquid state having high or low viscosity, sol, gel water, other inorganic solvents, an organic solvent, a solution, and a liquid phase resin, a flow regime like a liquid phase metal (a metallic melt), liquid as one state of the substance, as well as material in which particles of a functional material formed of solid bodies such as pigment and metallic particles are dissolved, dispersed or mixed into the solvent or the like. Furthermore, as a typical example of liquid, there is ink, liquid crystal, or the like as described in the above-mentioned embodiment. Herein, ink includes various liquid compositions such as a general water-based ink, an oil-based ink, gel ink, and hot-melt ink. As a specific example of the liquid ejecting apparatus, for example, there is a liquid ejecting apparatus which ejects liquid including materials such as an electrode material and a color material that are used in manufacturing a liquid crystal display, an EL (electroluminescence) display, a surface emitting display, and a color filter in the form of dispersion or dissolution. Otherwise, it may be possible to adopt a liquid ejecting apparatus which ejects biological organic matter used in manufacturing a bio chip, a liquid ejecting apparatus which is used as a precision pipette and ejects liquid serving as a sample, a printing device, a micro dispenser or the like. In addition, it may be possible to adopt a liquid ejecting apparatus which pinpoint-ejects lubricant oil to a precision machine such as a watch and a camera, a liquid ejecting apparatus which ejects transparent resin liquid such as an ultraviolet curing resin onto a substrate so as to form a micro hemispherical lens (an optical lens) or the like used in an optical communication element or the like, a liquid ejecting apparatus which ejects etching liquid such as acid or alkali so as to etch a substrate or the like. Furthermore, the present invention can be applied to any one kind of these liquid ejecting apparatus.

The entire disclosure of Japanese Patent Application No. 2012-040375, filed Feb. 27, 2012, is expressly incorporated by reference herein.

What is claimed is:

1. A liquid ejecting apparatus comprising:

an ejecting head having a nozzle forming surface formed with nozzles adapted to eject liquid;

an absorbent member having an outer surface of a cylindrical surface shape capable of absorbing the liquid attached to the nozzle forming surface;

a drive source that is driven, when moving the absorbent member in a direction in which the outer surface reaches the nozzle forming surface and in a direction in which the outer surface is separated from the nozzle forming surface, and is also driven when rotating the absorbent member;

a cam that rotates by driving of the drive source and moves the absorbent member in the direction separated from the nozzle forming surface by coming into contact with the absorbent member; and a contact member coming into contact with the outer surface of the absorbent member rotated along with driving of the drive source, wherein the contact member is located at a front side of the absorbent member so as to contact the absorbent member when the absorbent member is moved in the direction reaching the nozzle forming surface or the contact member is located at a rear side of the absorbent member so as to contact the absorbent member when the absorbent member is moved in the direction to separate from the nozzle forming surface, wherein the absorbent member has an absorbent member gear portion which is driving-connected to the drive source in at least one time when the absorbent member is nearest to the nozzle forming surface, and when the absorbent member is farthest from the nozzle forming surface, and an engagement portion capable of being engaged with the cam.

2. The liquid ejecting apparatus according to claim 1, wherein the drive source rotates the absorbent member in at least one time when the absorbent member is nearest to the nozzle forming surface by the rotation of the cam, and when the absorbent member is farthest from the nozzle forming surface.

3. The liquid ejecting apparatus according to claim 2, wherein the absorbent member has a rotation shaft portion.

4. The liquid ejecting apparatus according to claim 3, further comprising:

a transmission portion including at least one gear that transmits driving of the drive source to the absorbent member gear portion, wherein the absorbent member gear portion is located between at least one gear included in the transmission portion and the absorbent member, in a rotation shaft direction of the absorbent member.

5. The liquid ejecting apparatus according to claim 4, wherein the absorbent member gear portion is meshed with at least one gear included in the transmission portion when the absorbent member is nearest to the nozzle forming surface by the rotation of the cam.

6. The liquid ejecting apparatus according to claim 4, wherein the absorbent member gear portion is meshed with at least one gear included in the transmission portion when the absorbent member is farthest from the nozzle forming surface by the rotation of the cam.

7. The liquid ejecting apparatus according to claim 4, wherein the absorbent member gear portion is meshed with at least one gear included in the transmission portion when the absorbent member is nearest to the nozzle forming surface by the rotation of the cam and when the absorbent member is farthest from the nozzle forming surface by the rotation of the cam.

8. The liquid ejecting apparatus according to claim 1, wherein the absorbent member has an absorption portion that absorbs the liquid, the liquid ejecting apparatus has a wall portion facing both end portion of the absorption portion in the rotation shaft direction of the absorbent member, and the wall portion is placed between the drive source and the absorption portion in the rotation shaft direction.

9. The liquid ejecting apparatus according to claim 1, further comprising:

a cap member for capping the ejecting head, wherein the drive source is driven when moving the cap member in a direction in which the cap member contacts the ejecting head.

10. The liquid ejecting apparatus according to claim 1, further comprising:

a box like wall portion that surrounds both ends of the absorbent member, the wall like portion including groove portions that support the absorbent member and allow the absorbent member to move the direction in which the outer surface reaches the nozzle forming surface and in the direction in which the outer surface is separated from the nozzle forming surface.

* * * * *